US006674348B2

(12) United States Patent
Blecks et al.

(10) Patent No.: US 6,674,348 B2
(45) Date of Patent: Jan. 6, 2004

(54) SWITCH RELAY WITH SWITCHING STATUS DISPLAY

(75) Inventors: Michael Blecks, Berlin (DE); Karsten Pietsch, Berlin (DE); Bernd Saffian, Berlin (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 10/128,761

(22) Filed: Apr. 23, 2002

(65) Prior Publication Data

US 2003/0001703 A1 Jan. 2, 2003

(30) Foreign Application Priority Data

Apr. 26, 2001 (DE) ..... 101 20 452

(51) Int. Cl.[7] ..... H01H 73/12; H01H 75/00; H01K 7/14

(52) U.S. Cl. ..... 335/17; 335/78

(58) Field of Search ..... 335/17, 78–86

(56) References Cited

U.S. PATENT DOCUMENTS 4,771,253 A * 9/1988 Sasaki et al. ..... 335/17
4,890,080 A * 12/1989 Hashimoto ..... 335/17

FOREIGN PATENT DOCUMENTS

DE 19920742 C2 7/2000 ..... H01H/50/18
DE 19920742 A1 7/2000 ..... H01H/50/18

* cited by examiner

*Primary Examiner*—Ramon M. Barrera

(57) ABSTRACT

A switch relay with a switching status display is described, in which a display element is in operative connection with a switch contact of the switch relay and displays the switch positions in a clearly recognizable manner. The display element enlarges the display stroke so that contact movement is more readily visible. The principle is based on the elongation of a pointer of the flexing line of, for example, a constructed film hinge. As a result of the display element being constructed as a synthetic part low in mass, the contact dynamics are reduced by only a small extent.

13 Claims, 6 Drawing Sheets

SWITCH RELAY WITH SWITCHING STATUS DISPLAY

FIELD OF THE INVENTION

The invention relates to an electromagnetic switch relay and more particularly to such a relay having a visual indicator.

DESCRIPTION OF THE PRIOR ART

Switch relays are used in a variety of technical fields and particularly in the automotive industry. Switch relays exist in a variety of structural forms. For example, published patent application DE 19 920 742 A1 shows an electromagnetic relay having a base, a magnet system and an armature spring, in which the magnet system has an armature on which two lever sections are integrally formed. The lever sections form support points for the armature spring. A further support point for the armature spring is located on a fixed relay part. By bending the fixed relay part, the armature and thus a contact spacing may be adjusted.

One problem with known switch relays is that the switch state (closed or open) of the relay is frequently unascertainable. In the case of known relays, the contact arrangements may be checked through a viewing window in the relay housing. The contact spacing is constructed to be large enough so that when the switch contact is open, its state is visually recognizable. This construction has the disadvantage, however, that the contacts have to be arranged in the vicinity of a viewing window in the housing and moreover that the contact spacing when the contact is open must be made sufficiently large.

SUMMARY OF THE INVENTION

An object of the invention is therefore to provide an electromagnetic switch relay where the switching status is more readily recognizable.

Another object of the invention is to provide a display element for a switch relay for the purpose of displaying the switch position of the switch relay.

The switch relay according to the invention has a display element which is mounted movably, is in operative connection with the switch contact and is movable in dependence on the position of the switch contact from a rest position to a display position. The use of a mechanical display element provides the advantage that a clearly visible display of the switching status is possible regardless of the position of the contact elements. Furthermore, the display element provides the possibility of converting a small change in the contact spacings or a small change in the position of the armature into a clear alteration in the position of the display element, by way of the display element. This makes it possible to recognize the switching status of the switch relay simply on the basis of a clear alteration in the position of the display element.

Preferably, the display element is not connected directly to the switch contact, but is in operative connection with a component whereof the position is dependent on the position of the switch contact. In a preferred embodiment, the display element is in operative connection with the armature or an armature spring.

A flexible connection point having a pointer is included in the display element to enlarge the movement of the contact or armature. This makes a clearer display of the switch position possible. Preferably, the deflection of the switch contact is enlarged by way of a lever action and is converted to a larger deflection of the pointer or display element.

BRIEF DESCRIPTION OF THE DRAWINGS

The invention will be explained in more detail below with reference to the figures, in which.

DETAILED DESCRIPTION OF THE PREFERRED EMBODIMENT

Figure 1:
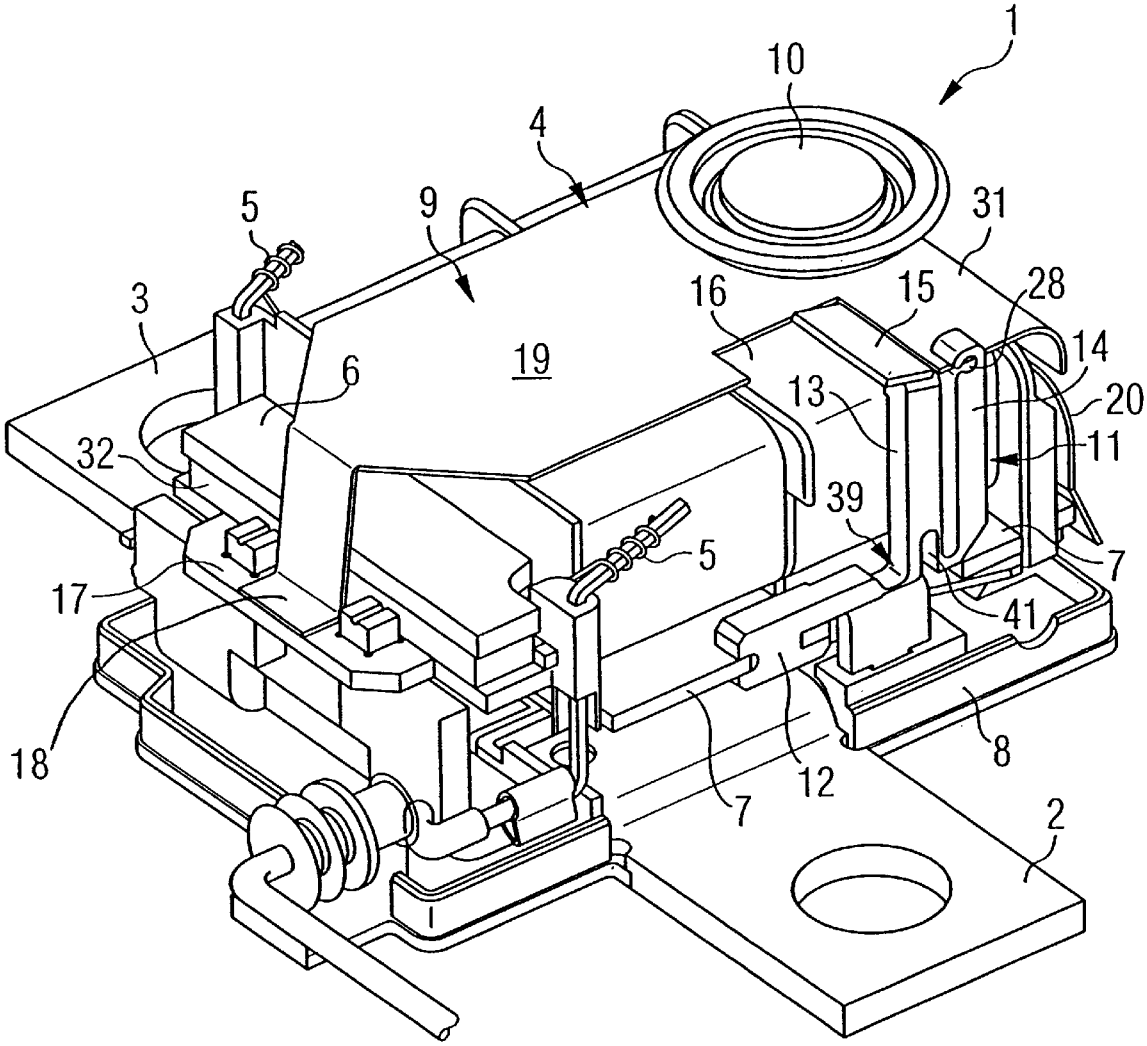
FIG. 1 shows a diagrammatic illustration of a switch relay, without a housing.
Figure 2:
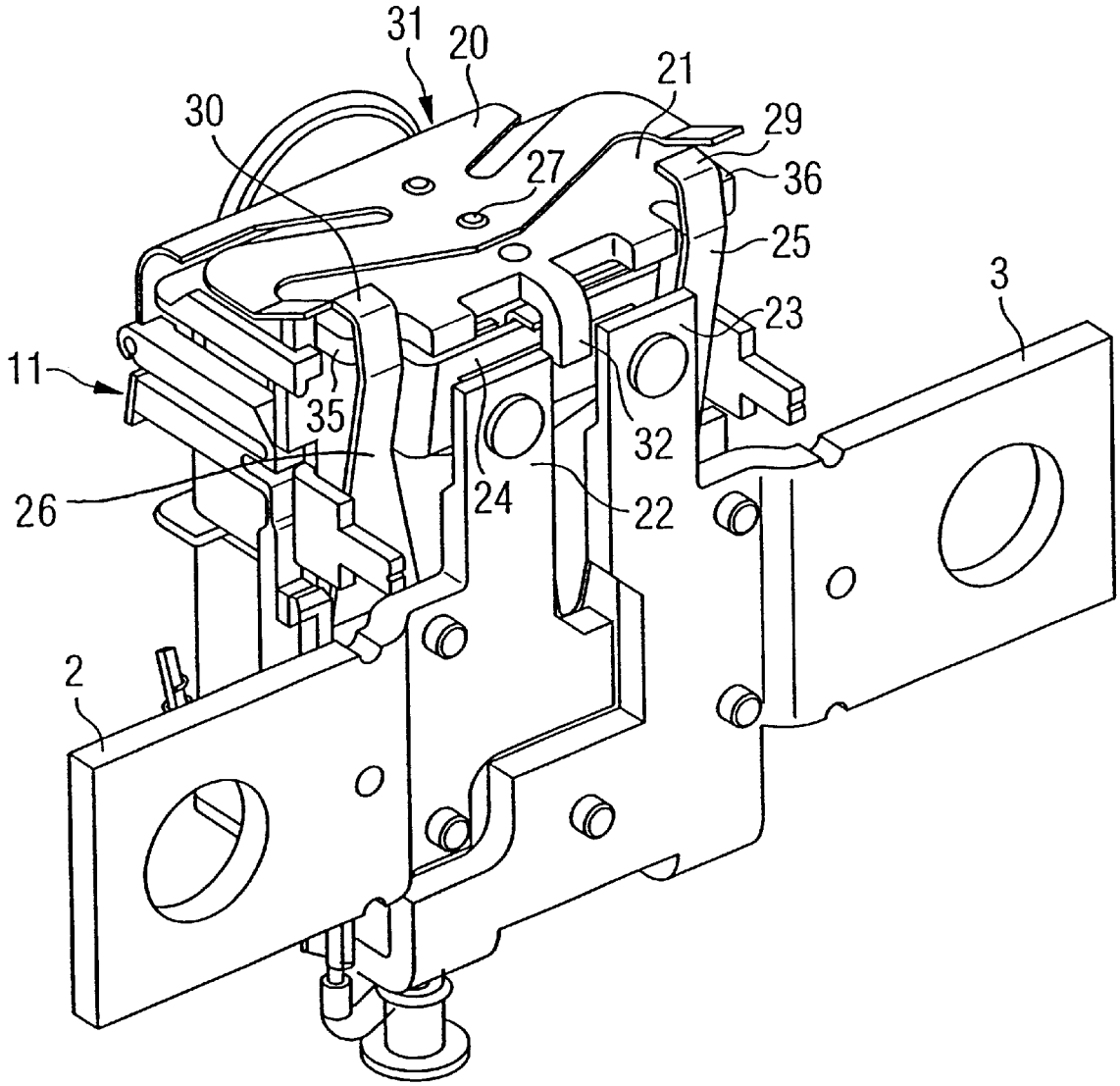
FIG. 2 shows a view of the switch relay from below.

FIG. 1 shows the main components of a switch relay 1, having the housing removed. The switch relay 1 has a magnet coil 4 positioned over a magnet core 6. A yoke 7 is positioned below the magnet coil 4 and abuts against a permanent magnet 32. The magnet core 6 lies over the permanent magnet 32. On the right-hand side, the yoke 7 projects beyond the magnet coil 4 and serves as an abutment face for an armature plate 21 (FIG. 2). The yoke 7 has at the left-hand end a holding plate 17 which is stamped into a Z shape. An armature spring 9 is secured to a first spring plate 18 on the upper side of the holding plate 17. The first spring plate 18 is angled upwards above the magnet coil 4 and is joined to a second spring plate 19. The second spring plate 19 is aligned substantially parallel to the upper side of the magnet coil 4 and extends to the right-hand end of the magnet coil 4. At the right-hand end of the magnet coil 4, the second spring plate 19 extends to a curved region 31. A third spring plate 20 extends from the curved region 31 and is arranged substantially parallel to the terminating face of the magnet coil 4.

Above the armature spring 9 is a button 10 which is mounted in the housing (not illustrated) of the switch relay 1. The button 10 has a central push surface which is connected by way of a resilient bellows to a fixed outer frame. The outer frame is mounted in the housing. The central push surface can be pressed downwards, by manual actuation, in the direction of the second spring plate 19 so that the spring plate 19 is pressed downwards.

The magnet coil 4 has electrical terminals 5 for triggering. Furthermore, a first and a second load terminal 2, 3 are provided which extend laterally below the yoke 7 and are conductively connected to one another or isolated from one another in dependence on the switch position of the switch relay 1. Arranged on a right-hand longitudinal side of the magnet coil 4 is a display element 11 which has a holding element 12, a first and a second arm 13, 14 and a display face 15. The holding element 12 is connected to the yoke 7. The holding element 12 is connected by way of a first resilient connection piece 39 to the first arm 13. The first arm 13 extends substantially perpendicularly from the yoke 7 upwards to below the second spring plate 19. The display face 15 is constructed at the end of the first arm 13 and extends laterally above the magnet coil 4. The second spring plate 19 has a display opening 16 over the display face 15.

FIG. 1 shows the display face 15 in a first position. The second arm 14 is connected to the first arm 13 by way of a second resilient connection piece 41 and is arranged substantially parallel to the first arm 13. At the upper end, the second arm 14 has a receiving region 28 which is made in the form of a slot. The second spring plate 19 is pushed into the receiving region 28 so that if there is a change in the vertical position of the second spring plate 19 the second arm 14 and thus the first arm 13 are also moved. This means that the display element 11 is clamped between the yoke 7 and the second spring plate 19. The position of the yoke 7 is fixed, so the position of the display face 15 depends only on the vertical position of the second spring plate 19. If for example the second spring plate 19 is pressed downwards, as illustrated in FIG. 1, then the spring arm 14 is also pressed downwards. Because of the linking of the second arm 14 to the first arm 13, a force is initiated at the lower end of the first arm 13, so that the arm 13 is pulled downwards and at the same time the first flexible connection piece 39 is bent downwards. As a consequence of this, the display face 15 is tilted down and to the right. Because of the length of the first arm 13, a small change in height in the second spring plate 19 is translated into a relatively large lateral pivotal movement of the display face 15. In the first position, the display face 15 is preferably inclined somewhat with respect to the planar surface of the second spring plate 19.

FIG. 2 shows a perspective view of the switch relay 1 from below. Here, the shape of the first and second load terminals 2, 3 can clearly be seen, respectively opening out into a first and second contact piece 22, 23, each extending parallel below the right-hand end of the magnet coil 4. An electrically conductive contact bridge 24 is arranged above the ends of the first and second contact pieces 22, 23 and represents the switch contact. The contact bridge 24 is held on opposing sides by a first and a second spring arm 25, 26 of a spring contact. The first and second spring arms 25, 26 respectively have in the end region a first and a second angled end piece 29, 30 extending behind the armature plate 21. The armature plate 21 lies on the first and second end regions 29, 30 by means of a first and second support region 35, 36. The armature plate 21 is connected to the third spring plate 20 by way of rivets. In the rest position, the armature plate 21 is kept in an upper position, so the contact bridge 24 is also raised away from the first and second contact pieces 22, 23 by the spring force of the spring contact arms 25, 26. In this position, the first and second contact pieces 22, 23 are electrically isolated from one another. If the button 10 is now pressed downwards, then at the same time the second spring plate 19 and the third spring plate 20 are pressed downwards. As a consequence of this, the armature plate 21 is also moved downwards. The armature plate 21 presses the first and second spring arms 25, 26 downwards by means of the first and second support regions 35, 36 until the contact bridge 24 lies on the upper sides of the first and second contact pieces 22, 23. In this position, the first and second load terminals 2, 3 are electrically connected to one another. At the same time as the second spring plate 19 is pressed down, the second arm 14 is also pressed downwards and because of the resilient mounting of the first arm 13 the first arm 13 is tilted in the direction of the armature plate 21. Consequently, the display face 15 is pivoted out of a display region provided and is preferably moved below the second spring plate 19.

Figure 3:
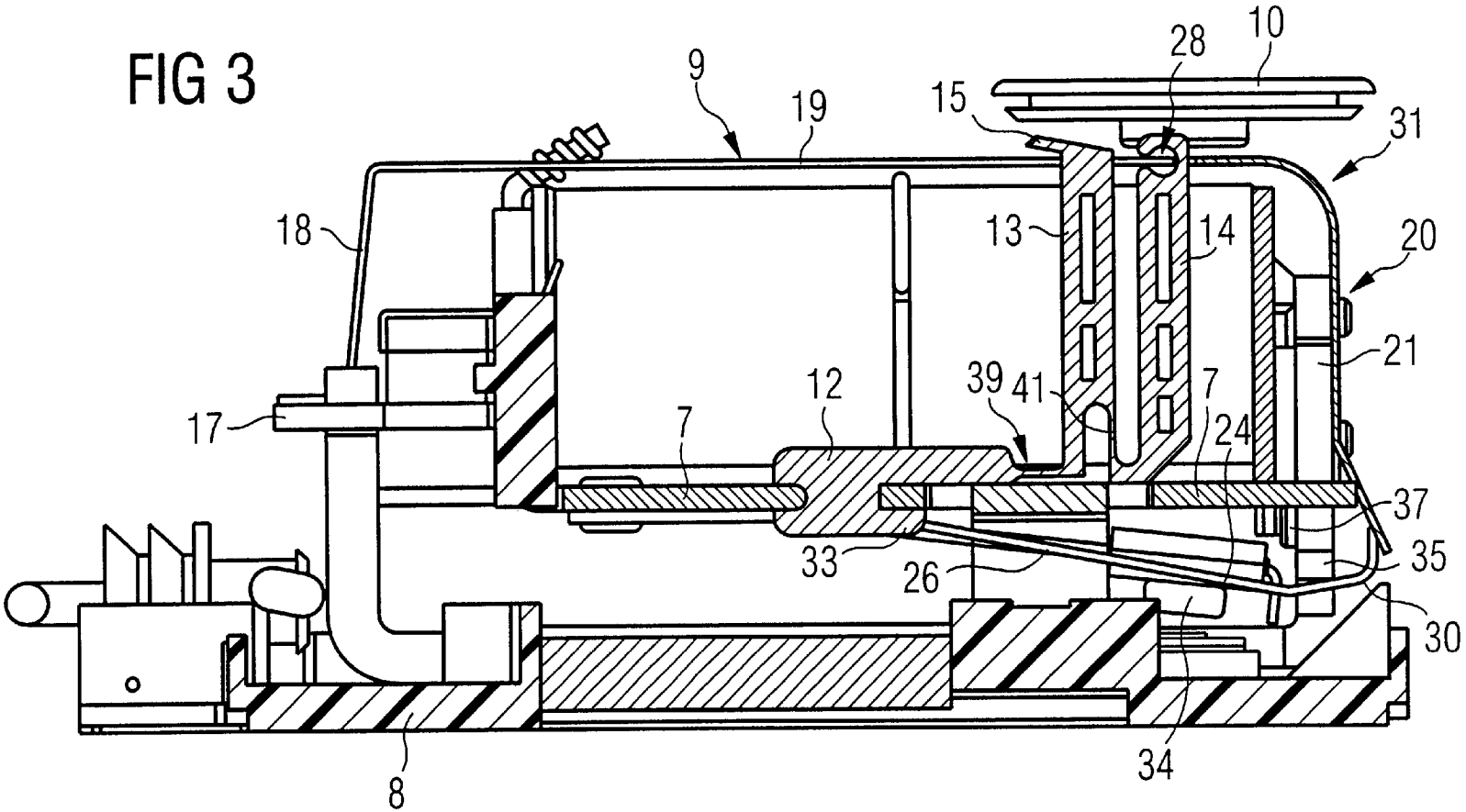
FIGS. 3 and 3*a* show a section through the switch relay.

FIG. 3 shows a cross-section through the switch relay 1, in which once again the shape of the display element 11 is clearly visible. In FIG. 3, the switch relay 1 is illustrated without the load terminals 2, 3 and the first and second contact pieces 22, 23. The position illustrated corresponds to a closed switching status of the relay. In this position, the contact bridge 24 is pressed downwards by way of the spring arms 25, 26. On the underside the contact bridge 24 has a contact block 34 which serves to improve the contact made by the first and second contact pieces 22, 23. The first and second spring arms 25, 26 extend as far as the center of the magnet coil 4 and are connected to the yoke 7 on the underside of the yoke 7. The alignment of the first and second spring arms 25, 26 is such that the contact bridge 24 is held in an upper position in which the contact bridge 24 is raised away from the first and second contact pieces 22, 23. As a result of the action of the armature plate 21, however, the first and second spring arms 25, 26 are pressed downwards in the direction of the first and second contact pieces 22, 23, as illustrated in FIG. 3. The armature plate 21 has a holding lug 37 on an inner side, and this projects out of the surface of the armature plate 21. The holding lug 37 is constructed in such a way that the armature plate 21 which was pressed downwards by manual actuation of the button 10 is on the one hand pulled by the spring contact 9 in the direction of the magnet coil 4 and is held in the lower position by the holding lug 37, which reaches below the yoke 7. The holding lug 37, in the lower position, abuts against the underside of the yoke 7 and hence prevents the armature plate 21 from being moved back upwards. The contact bridge lies in the lower position, on the first and second contact pieces 22, 23.

Figure 3A:
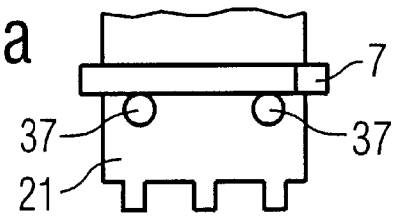

FIG. 3A is a diagrammatic cross-sectional illustration showing the armature plate 21 in the lower position, in which two holding lugs 37 are arranged below the yoke 7 and prevent upward movement of the armature plate 21.

If the conductive connection between the first and the second load terminals 2, 3 is now to be opened, the magnet coil 4 is supplied with current. The magnet coil 4 consequently generates a magnetic field which counters the magnetic field of the permanent magnet and thus reduces the magnetic force acting on the armature plate 21. Consequently, the armature plate 21 is pulled away from the yoke 7 by the armature spring 9. Thus the holding lugs 37 are moved in front of the yoke 7, so that upward movement of the armature plate 21 is made possible. Because the armature spring 9 is preloaded upwards, the armature plate 21 is moved upwards into an upper position. As a result of the upward movement of the armature plate 21 the first and second spring arms 25, 26 are relieved of their load, so the first and second spring arms 25, 26 also pivot upwards and thus the contact bridge 24 is raised away from the first and second contact pieces 22, 23. Consequently, the first and second load terminals 2, 3 are electrically isolated from one another again.

Figure 4:
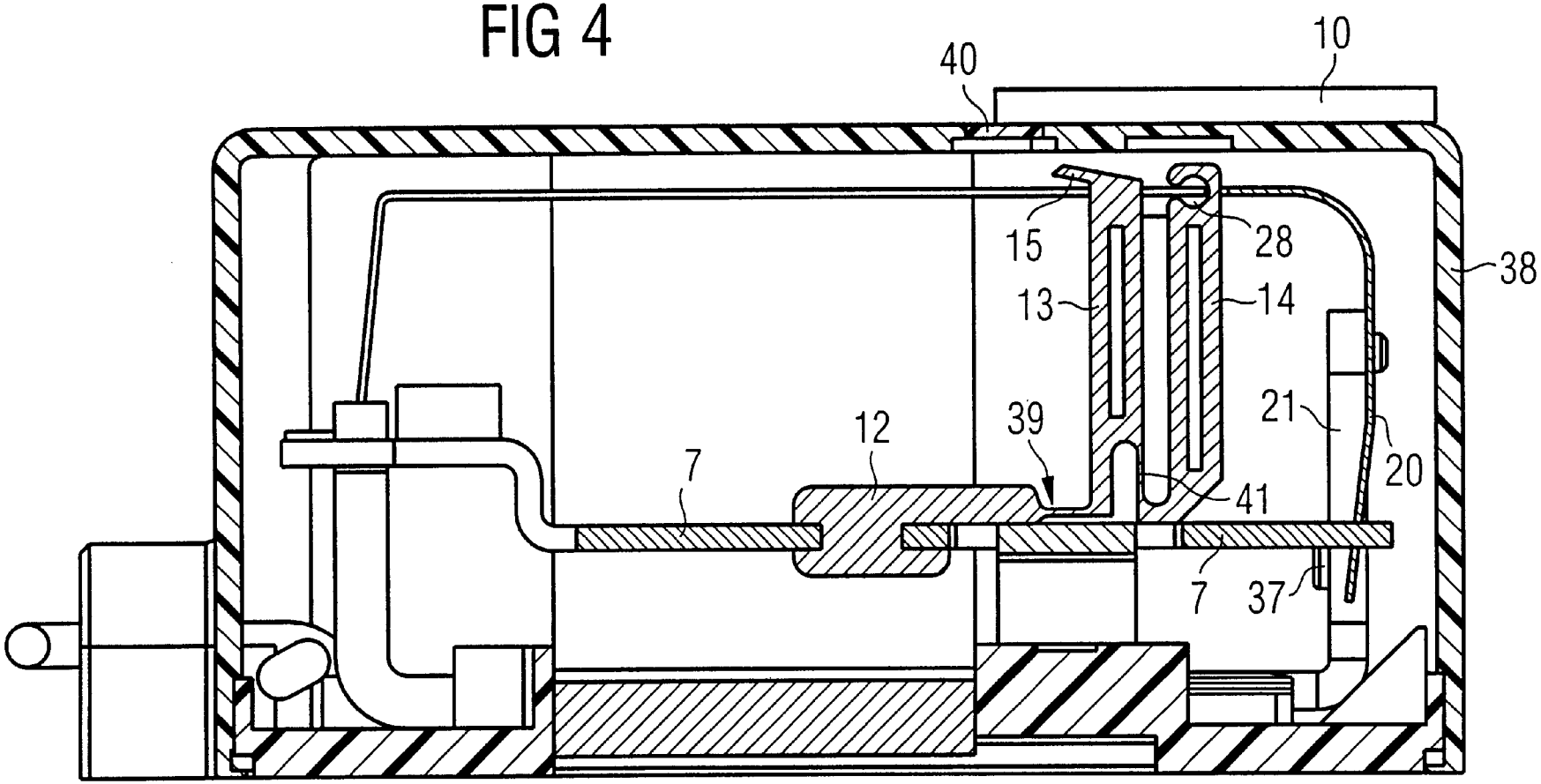
FIG. 4 shows a second section through the switch relay.

FIG. 4 shows a further sectional illustration of the switch relay 1, in which a housing 38 surrounding the switch relay 1 is illustrated. The armature plate 21 is located in the lower position in which the armature plate 21 is kept below the yoke 7 by the holding lug 37. At the same time, the armature plate 21 is pre-tensioned in the direction of the yoke 7 by the magnetic field of the permanent magnet. The pre-tensioning force of the armature spring 9 in the direction away from the yoke 7 is smaller than the force of attraction of the permanent magnet. A viewing window 40 is made in the housing 38 above the display opening 16.

Figure 5:
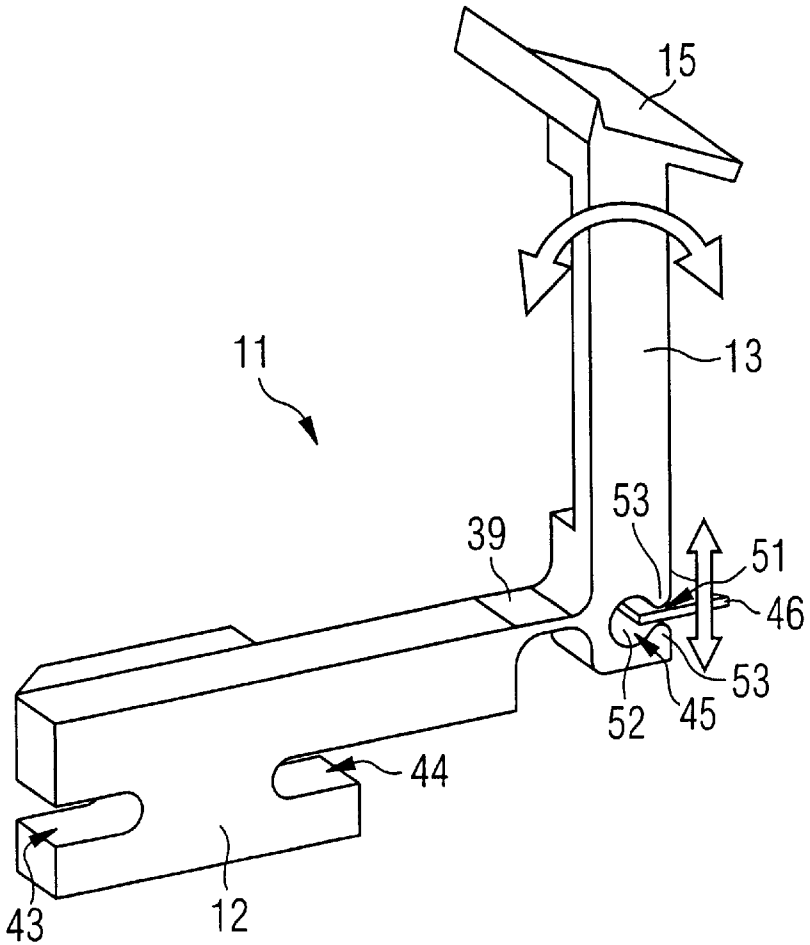
FIG. 5 shows a perspective illustration of a first embodiment of the display element.

FIG. 5 shows, in an enlarged perspective illustration, the display element 11. The display element 11 is made in a simple construction from a synthetic material. Synthetic material is particularly suitable for constructing the first connection piece 39, which although it should ensure a determined rest position of the arm 13 should also enable a tilting movement of the arm 13. These resilient properties are provided by a large number of types of synthetic. Moreover, the production of the display element 11 from synthetic offers the advantage that the display element 11 is low in mass and so changes the contact dynamics little.

The holding element 12 has a first and a second holding recess 43, 44. The first and second holding recesses 43, 44 are made on opposing sides on the short side edges of the holding element 12. As can be seen from the preceding figures, parts of the surface of the yoke 7 are inserted into the first and second holding recesses 43, 44 so that the holding element 12 is fixedly connected to the yoke 7. The upper part of the holding element 12 is made in the form of a preferably square bar which extends to the first connection piece 39. The first connection piece 39 preferably has the same width as the holding element 12 but a perceptibly smaller height than the bar of the holding element 12. Because of this sizing, a tilting movement is made possible in the plane of the longitudinal direction of the bar of the holding element 12. The plane of the tilting movement is indicated in FIG. 5 by a double-headed arrow. In a lower end region, the first connection piece 39 extends to the arm 13. The lower end region has a second receiving region 45 opposite the connection to the first connection piece 39. The second receiving region 45 has in cross-section a narrow opening region 51 which opens into a larger receiving space 52. The opening region is made on the side of the arm 13, arranged opposite the connection region of the first connection piece 39. Two holding edges 53 oppose one another in the opening region 51 and delimit the opening region 51. The spacing between the holding edges 53 is selected such that a connection element 46 pushed into the second receiving region 45 is held by the two holding edges. The receiving space is sized to be large enough for pivoting of the arm 13 to be possible without movement of the inserted connection element 46 being hindered. Preferably, the armature spring 9 is used as the connection element. However, it is also possible for any other connection element to the switch contact 24 to be used.

The arm 13 is preferably of wider construction in the lower region than in the upper region. The wider construction makes it possible to improve the coupling between the first arm 13 and the connection element 46, which is for example as illustrated in the preceding figures in the form of the armature spring 9. The central region of the first arm 13 may have a smaller cross-section for adequate rigidity. Preferably, at the upper end the cross-section of the first arm 13 becomes larger again in order to keep the even larger display face 15 stable. If the connection element 46 is moved upwards, the first arm 13 pivots in the direction of the holding element 12. Because of the small spacing between the first connection piece 39 and the second receiving region 45, and the large spacing between the first connection piece 39 and the second end of the first arm 13 with the display face 15, a pointer action is generated by means of which a small change in the vertical position of the connection element 46 is converted to a relatively large pivotal movement of the display face 15.

Figure 6:
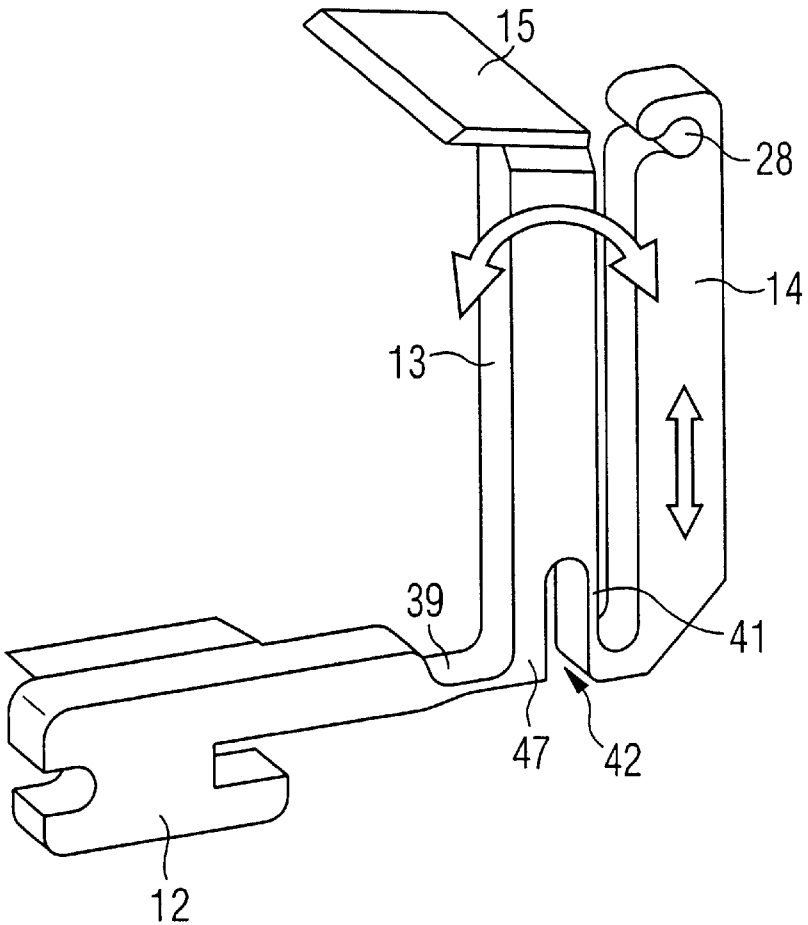
FIG. 6 shows a perspective illustration of a second embodiment of the display element.

FIG. 6 shows a second embodiment of the display element 11. In the second embodiment, the first connection piece 39 is constructed in a lower region of the bar of the holding element 12 and, in a lower end region, extends to a first end web 47 of the first arm 13. The lower end of the first arm 13 has a second end web 41 by way of which the first arm 13 is connected to the second arm 14. The first and second end webs 47, 41 are separated from one another by a slot 42 which is made from below in the lower end of the first arm 13. The second arm 14 is arranged substantially parallel to the first arm 13. The second arm 14 has a first receiving region 28 in the upper end region, constructed in a manner corresponding to the second receiving region 45. The first arm 13 ends in the display face 15 in the region of the first receiving region 28. The display face 15 has a preferably rectangular shape and extends, starting from the first arm 13, in a direction perpendicular to the first arm 13 into the plane of the drawing. The alignment of the display face 15 extends to above the magnet coil 4 in the assembled condition.

A connection element 46 is inserted into the first receiving region 28 in the assembled condition, as illustrated in FIG. 5. If the connection element moves upwards, the second arm 14 is also moved upwards and hence the first arm 13 is tilted in a pivotal movement in the direction of the holding element 12. If the connection element 45 is moved downwards, the second arm 14 is also moved downwards and the first arm 13 is tilted away from the holding element 12. During the tilting movements, there is a flexing in the region of the first connection piece 39. The first connection piece 39 is constructed in accordance with the embodiments of the display elements 11 of FIGS. 5 and 6 in such a way that a rest position of the first arm or of the first and second arms is determined. The first connection piece 39 is preferably constructed as a film hinge.

Figure 7:
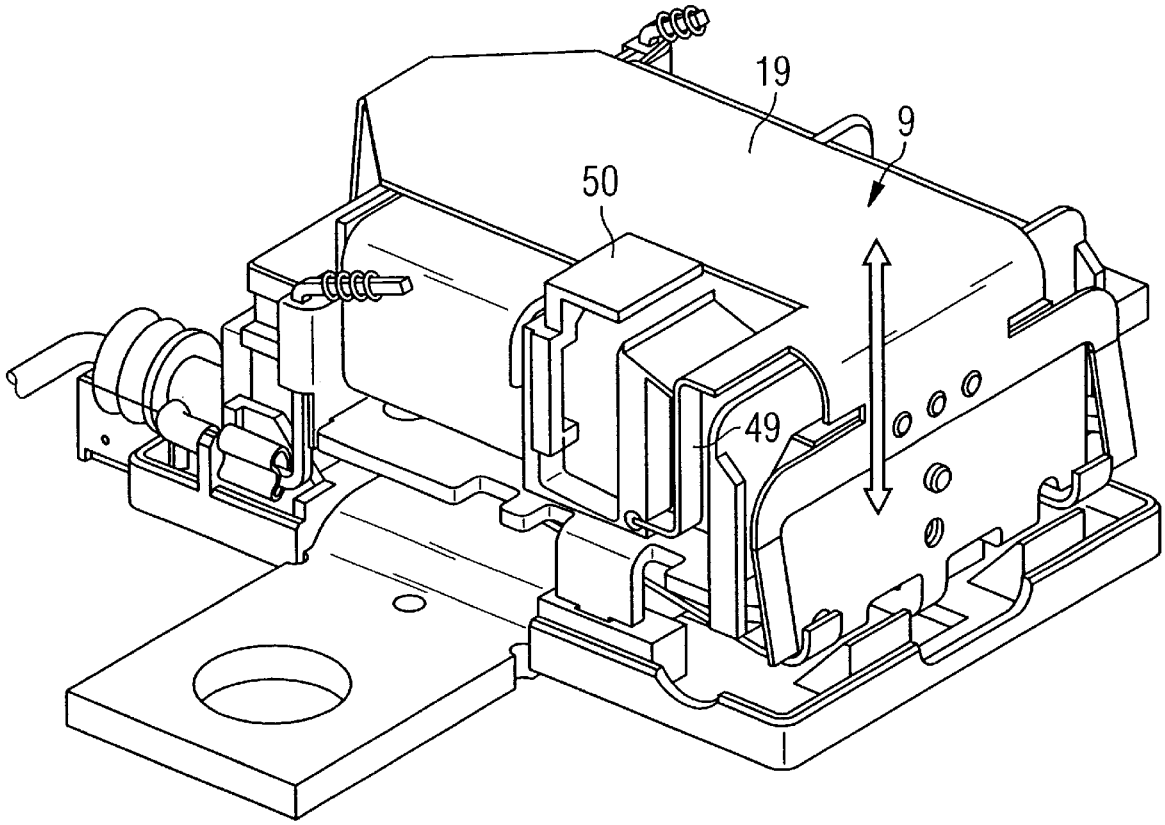
FIG. 7 shows a further embodiment of the switch relay.

The first arm 13 with the display face 15 is forcibly guided by the second arm 14. FIG. 7 shows a further embodiment of a switch relay which has a display element 15 corresponding in its essential parts to the display element of FIG. 5. The button 10 is not illustrated. In this embodiment, the second spring plate 19 is bent into an actuation strip 49 which extends downwards in the direction of the second receiving region 45. The actuation strip 49 is bent in its end region in the direction of the second receiving region 45 and by means of the end region is pushed into the second receiving region 45. In this way, it becomes possible to transmit the alteration in the vertical position of the second spring plate 19 downwards onto the second receiving region 45.

Figure 8:
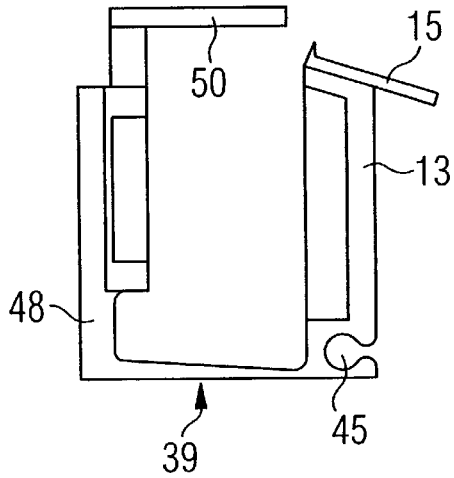
FIG. 8 shows a further embodiment of the display element.

FIG. 8 shows a cross-section through the display element 15 of FIG. 7, which has a second holding element 48. The second holding element 48 is arranged substantially parallel to the first arm 13 and has a cover surface 50 in the upper region. The cover surface 50 extends in the lateral direction, starting from the second holding element 48, like the display face 15. Preferably, the central region of the second holding element 48 is shaped in such a way that the central region is pushed laterally onto the side face of the magnet coil 4 and hence the second holding element 48 is held fixedly in its position. The second spring plate 19 has a display opening 16, with the cover plate 50 being constructed to match the display opening 16 and covering a partial region of the display opening 16. The display element 15 is arranged in front of the cover plate 50 in the installed condition and is thus visible from above. The situation illustrated in FIG. 7 corresponds to the condition in which the switch relay is connected to be conductive. If the armature plate 21 is moved upwards out of the lower position by a corresponding supply of current to the magnet coil 4 and a corresponding action of the armature spring 9, then the vertical position of the second spring plate 19 and the vertical position of the lower end of the actuation strip 49 are also moved upwards. As a consequence of this, the first arm 13 is tilted in the direction of the second holding element 48 and the cover surface 15 is preferably moved completely below the cover plate 50. This means that the display face 15 is no longer visible from above. Consequently, the altered switch position of the relay is shown in a visually readily recognizable manner.

The embodiment of the display element 11 and the switch relay 1 illustrated in FIGS. 7 and 8 has the advantage that no second arm 14 is required and that preferably there is pre-positioning of the cover plate 50 and the display face 15. The display element 11 has, besides the display face 15, the cover plate 50 which covers the cover face 15 when the first arm 13 is in a predetermined pivot position.

The display element enlarges the display stroke so that a contact movement is more readily visible. The principle is based on the elongation of a pointer of the flexing line of a film hinge. As a result of the display element, constructed as a synthetic part low in mass, the contact dynamics are reduced by only a small extent.

We claim:

1. A switch relay having a switch contact for electrically switching two terminals the switch relay comprising:

a display element being movably mounted in operative connection with the switch contact, the display element is mounted at a flexible connection point to be pivotal between a rest position and a display position in dependence on the position of the switch contact.

2. A switch relay according to claim 1 wherein the display element further comprises a holding element, an arm and a display face, the holding element being connected to the switch relay and to one end of the arm by way of the flexible connection point, and the display face being arranged at the other end of the arm.

3. A switch relay according to claim 2 wherein the display element is connected to an armature by a spring element.

4. A switch relay according to claim 3 wherein the spring element is a pre-tensioning spring and the pre-tensioning spring is clamped between the switch relay and the armature to exert a pre-tensioning force on the armature in the direction of the rest position.

5. A switch relay according to claim 3 wherein the spring element is inserted into a receiving opening in the display element, and adopts different vertical positions depending on the position of the armature, whereby the different vertical positions effect tilting of the display element.

6. A switch relay according to claim 5 wherein the display element further comprises a second arm being secured to the first arm and being in operative connection with the spring element.

7. A switch relay according to claim 6 wherein the second arm is connected to the first end of the first arm.

8. A switch relay according to claim 7 wherein the second arm is arranged substantially in a plane with the first arm.

9. A switch relay according to claim 8 wherein the second arm is connected at a second end to a connection element, being in operative connection with the armature.

10. A switch relay according to claim 9 further comprising an actuation means being in operative connection with the armature, the actuation means acting on the armature to urge it into a closed position in which a contact element makes contact with the terminals and electrically connects them.

11. A switch relay according to claim 10 further comprising a holding mechanism which keeps the armature in the closed position and a detaching mechanism actuatable to move the armature from the closed position to a rest position.

12. A switch relay according to claim 11 wherein the holding mechanism comprises a projection on the inside of the armature whereby in the closed position the projection extends behind an abutment edge of the yoke and keeps the armature in the closed position.

13. A switch relay according to claim 12 wherein the detaching mechanism comprises a pre-tensioning spring which forcibly urges the armature away from the magnet core such that when the current supply is switched on, the magnet coil generates a countering magnetic field which weakens the magnetic field of the permanent magnet so that the pre-tensioning spring pulls the armature away from the magnet core and the armature pivots into the rest position in which the contact element is raised away from the terminals.

* * * * *